US010202838B2

(12) United States Patent
Hinkie et al.

(10) Patent No.: US 10,202,838 B2
(45) Date of Patent: Feb. 12, 2019

(54) VERIFICATION OF SWELLING IN A WELL

(71) Applicant: Halliburton Energy Services, Inc., Houston, TX (US)

(72) Inventors: Ronald L. Hinkie, Houston, TX (US); Kurtis W. Price, Cypress, TX (US); Alf. K. Sevre, Houston, TX (US); Scott Wendorf, University Park, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/912,612

(22) Filed: Mar. 6, 2018

(65) Prior Publication Data

US 2018/0195377 A1 Jul. 12, 2018

Related U.S. Application Data

(62) Division of application No. 14/728,107, filed on Jun. 2, 2015, now Pat. No. 9,938,817, which is a division (Continued)

(51) Int. Cl.
*E21B 47/00* (2012.01)
*E21B 47/12* (2012.01)

(Continued)

(52) U.S. Cl.
CPC ..... *E21B 47/00* (2013.01); *E21B 33/12* (2013.01); *E21B 33/1208* (2013.01); *E21B 47/06* (2013.01); *E21B 47/12* (2013.01)

(58) Field of Classification Search
CPC ..... E21B 47/00; E21B 47/06; E21B 47/12; E21B 33/12; E21B 33/1208; E21B 34/06; E21B 33/127
See application file for complete search history.

(56) References Cited

U.S. PATENT DOCUMENTS 6,009,947 A 1/2000 Wilson et al.
7,431,098 B2 10/2008 Ohmer et al.

(Continued)

FOREIGN PATENT DOCUMENTS

GB 2443724 A 5/2008

OTHER PUBLICATIONS

Nano Sonic, Inc.; "Metal Rubber Sensors and Electrodes," Product #: MR-01-D5 and MR-01-S5, undated. (3 pages).

(Continued)

*Primary Examiner* — Wei Wang
(74) *Attorney, Agent, or Firm* — Locke Lord LLP; Joseph A. Farco; Joshua L. Jones

(57) ABSTRACT

A method of verifying swelling of a swellable material in a well can include connecting a transmitter to a sensor which senses a parameter indicative of degree of swelling of the swellable material, and conveying a receiver into an interior of a tubular string. The transmitter transmits to the receiver an indication of the degree of swelling of the swellable material. A packer swelling verification system can include a swellable material which swells in a well, and a well tool which is conveyed to the packer in the well. The well tool receives an indication of a degree of swelling of the swellable material. A method of verifying whether a swellable material has swollen in a well can include positioning a conductor proximate the swellable material, whereby the conductor parts in response to swelling of the swellable material, and detecting whether the conductor has parted.

2 Claims, 4 Drawing Sheets

Related U.S. Application Data of application No. 13/112,343, filed on May 20, 2011, now Pat. No. 9,074,464.

(51) Int. Cl.
*E21B 47/06* (2012.01)
*E21B 33/12* (2006.01)

(56) References Cited

U.S. PATENT DOCUMENTS

| | | | |
|---|---|---|---|
| 7,475,723 | B2 | 1/2009 | Ring et al. |
| 7,665,355 | B2 | 2/2010 | Zhang et al. |
| 7,798,225 | B2 | 9/2010 | Giroux et al. |
| 2005/0199401 | A1 | 9/2005 | Patel et al. |
| 2007/0151724 | A1 | 7/2007 | Ohmer et al. |
| 2007/0235185 | A1 | 10/2007 | Patel et al. |
| 2008/0077016 | A1 | 3/2008 | Sparks et al. |
| 2008/0185144 | A1 | 8/2008 | Lovell |
| 2009/0139710 | A1 | 6/2009 | Robisson et al. |
| 2010/0101786 | A1 | 4/2010 | Lovell et al. |
| 2010/0212883 | A1 | 8/2010 | Emerson et al. |
| 2010/0212891 | A1 | 8/2010 | Stewart et al. |
| 2010/0252256 | A1 | 10/2010 | Plooy et al. |
| 2011/0132096 | A1 | 6/2011 | Ricks |

OTHER PUBLICATIONS

Jul. 25, 2014 New Zealand First Examination Report in NZ Patent Application No. 617120, 2 pages.
Sciencentral; "Metal Rubber" by Karen Lurie, online article, dated Sep. 14, 2004, 2 pages.
Science Daily; "Metal Rubber: Chemists Create Self-assembling Conductive Rubber"; online research news article, Apr. 1, 2007, 2 pages.
Science Daily; Metal Rubber: Chemists Create Self Assembling Conductive Rubber; online research news article, Apr. 1, 2008, 2 pages.
Steve Krar, "Metal Rubber", product paper, 3 pages.
Nano Sonic, Inc., "Metal Rubber Sensors & Electrodes," product information, Mar. 8, 2011, 1 page.
Nano Sonic, Inc.; "Metal Rubber Strain & Skin Friction Sensors," product information, Apr. 15, 2011, 1 page.
International Search Report and Written Opinion dated Nov. 30, 2012 for PCT Application No. PCT/US2012/037133, 9 pages.
Information disclosure statements for U.S. Appl. No. 13/112,343.
http://www.thefreedictionary/com/p/part, dated Sep. 26, 2014, 12 pages.
Non-patent literature cited in U.S. Appl. No. 13/112,345.
Mar. 23, 2015 Austrialian Patent Examination Report in AU Patent Application No. 2012259230, 3 pages.
Feb. 25, 2015 Canadian Examination Search Report in CA Patent Application No. 2,836,543, 3 pages.
Aug. 31, 2015 Gulf Cooperation Council Examination Report in GC Patent Applilucation No. GC 2012-21272, 4 pages.
Aug. 10, 2015 African Regional Intellectual Property Organization (ARIPO) Examination Report in AP Patent Application No. AP/P/2013/007244, 4 pages.
Aug. 20, 2015 Egyptian Patent Office Office Action in Egyptian Patent Application No. 1652/2013, 3 pages.
Nov. 23, 2015 Notice of Allowance in Canadian Intellectual Property Office in CA Patent Application No. 2,836,543, 1 page.
Office Action from Canadian Intellectual Property Office in CA Application No. 2,901,432, 4 pages.
Second Examination Report from Patent Office of the Cooperation Council for the Arab States of the Gulf in GC Application No. GC2012-21272, 6 pages.
Extended European Search Report, dated May 11, 2016, 6 pages.
Partial European Search Report issued in corresponding European Patent Application No. EP 18165341, dated Jul. 27, 2018.
European Search Report Issued in Corresponding European Patent Application No. 18165341.1, dated Nov. 19, 2018 (9 pages).

VERIFICATION OF SWELLING IN A WELL

CROSS-REFERENCE TO RELATED APPLICATIONS

This application is a divisional of application Ser. No. 14/728,107 filed on 2 Jun. 2015, which was a divisional of prior application Ser. No. 13/112,343 filed on 20 May 2011. The entire disclosure of these prior applications are incorporated herein by reference.

BACKGROUND

This disclosure relates generally to equipment utilized and operations performed in conjunction with a subterranean well and, in an example described below, more particularly provides for verification of swelling of a swellable material in a well.

Swellable packers are used in wellbores, for example, to seal off an annular area between a tubular member (such as tubing, casing, pipe, etc.) and an outer structure (such as a wellbore or another tubular member). A swellable packer can include a swellable seal element which swells after it is placed in the wellbore. The seal element may swell in response to contact with a particular fluid (such as oil, gas, other hydrocarbons, water, etc.).

One problem with swellable packers is that it typically takes a long time for the seal element to swell, and sometimes it can take longer than other times for the seal element to swell. So, activities in the well have to cease for a long time, until personnel are sure that the seal element is fully swollen.

If there were a way to conveniently determine whether the seal element is fully swollen, the wait time could be significantly reduced (e.g., one would have to wait only so long as it takes for the seal element to swell sufficiently to effect a seal). It will, thus, be appreciated that improvements would be beneficial in the art of verifying whether a swellable material has swollen in a well. Such improvements would be useful, for example, in determining whether a seal element is sufficiently swollen.

SUMMARY

In the disclosure below, systems and methods are provided which bring improvements to the art of verifying whether a swellable material has swollen in a well. One example is described below in which a conductor is parted in response to swelling of the swellable material. Another example is described below in which a sensor detects swelling of the swellable material.

In one aspect, the disclosure below provides to the art a method of verifying whether a swellable material has swollen in a well. The method can include connecting a transmitter to a sensor which senses a parameter indicative of degree of swelling of the swellable material, and conveying a receiver into an interior of a tubular string. The transmitter transmits to the receiver an indication of the degree of swelling of the swellable material.

In another aspect, a packer swelling verification system is described below. The system can include a swellable material which swells in a well, and a well tool which is conveyed to the packer in the well. The well tool receives an indication of a degree of swelling of the swellable material.

In yet another aspect, a method of verifying whether a swellable material has swollen in a well may include the steps of positioning a conductor proximate the swellable material, whereby the conductor parts in response to swelling of the swellable material, and detecting whether the conductor has parted.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
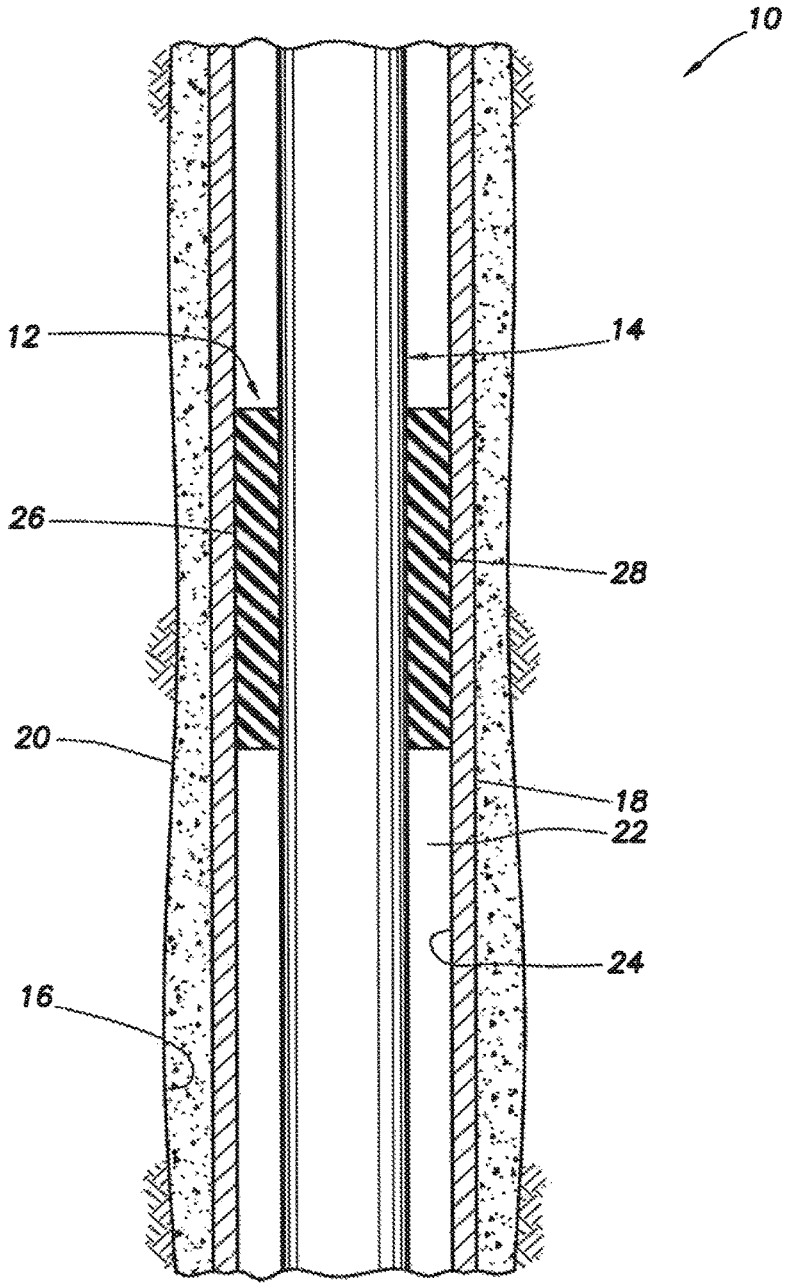
FIG. 1 is a representative partially cross-sectional view of a well system and associated method which can embody principles of this disclosure.

Representatively illustrated in FIG. 1 is a well system 10 and associated method which can embody principles of this disclosure. In the example of FIG. 1, a swellable packer 12 is interconnected as part of a tubular string 14 (e.g., tubing, casing, liner, etc.) positioned in a wellbore 16. The wellbore 16 is lined with casing 18 and cement 20, but in other examples, the packer 12 could be positioned in an uncased or open hole portion of the wellbore.

An annulus 22 is formed radially between the tubular string 14 and an inner wall 24 of the casing 18. When swollen as depicted in FIG. 1, a seal element 26 of the packer 12 contacts and seals against the wall 24, thereby blocking fluid flow through the annulus 22. If the packer 12 swells in an uncased portion of the wellbore 16, the wall 24 is the wellbore wall.

The seal element 26 includes a swellable material 28. Preferably, the swellable material 28 swells when it is contacted with a particular swelling fluid (e.g., oil, gas, other hydrocarbons, water, etc.) in the well. The swelling fluid may already be present in the well, or it may be introduced after installation of the packer 12 in the well, or it may be carried into the well with the packer, etc. The swellable material 28 could instead swell in response to exposure to a particular temperature, or upon passage of a period of time, or in response to another stimulus, etc.

Thus, it will be appreciated that a wide variety of different ways of swelling the swellable material 28 exist and are known to those skilled in the art. Accordingly, the principles of this disclosure are not limited to any particular manner of swelling the swellable material 28.

Furthermore, the scope of this disclosure is also not limited to any of the details of the well system 10 and method described herein, since the principles of this disclosure can be applied to many different circumstances. For example, the principles of this disclosure can be used to determine a degree of swelling of a swellable material in a well, without that swellable material being included in a packer or being used to seal off an annulus in the well.

Figure 2:
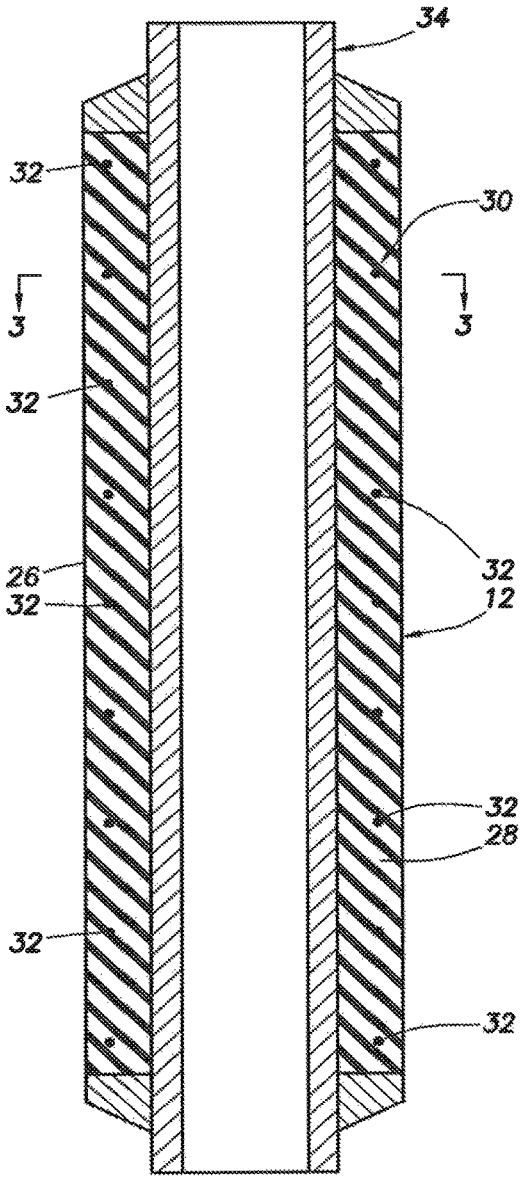
FIG. 2 is a representative cross-sectional view of a swellable packer which can embody principles of this disclosure.

Referring additionally now to FIG. 2, an enlarged scale cross-sectional view of one example of the packer 12 is representatively illustrated. In this view, it may be seen that the packer 12 incorporates a packer swelling verification system 30, which can be used to verify whether the seal element 26 has swollen sufficiently to effect a seal against the wall 24.

In this example, the system 30 includes a series of conductors 32 embedded in the swellable material 28. The conductors 32 are in the form of rings which encircle a mandrel or base tubular 34. The tubular 34 is provided for interconnecting the packer 12 in the tubular string 14.

In other examples, the conductors 32 could be external to the seal element 26, or otherwise positioned. Preferably, the conductors 32 are arranged, so that the conductors part when the swellable material 28 swells. As used herein, the term "part" is used to indicate a loss of electrical conductivity between portions of the conductors, and not necessarily requiring a breakage of the conductors.

For example, a conductor 32 could part when ends of the conductors (which were previously in contact with each other) are separated. A conductor 32 could part when a switch between sections of the conductor is opened. Thus, it should be understood that the scope of this disclosure is not limited to any particular manner of parting the conductors 32.

Figure 3:
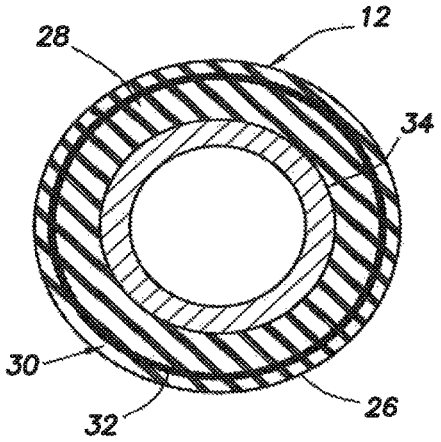
FIG. 3 is a representative cross-sectional view of the swellable packer, taken along line 3-3 of FIG. 2, the swellable packer being unswollen.
Figure 4:
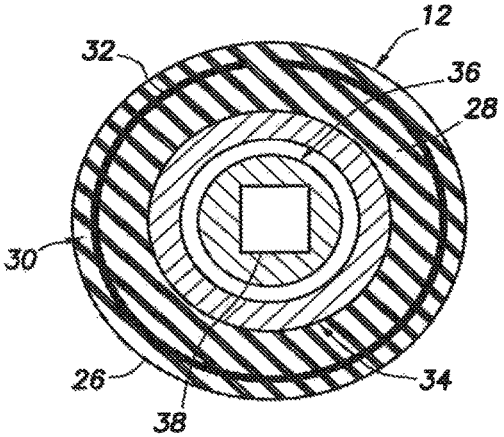
FIG. 4 is a representative cross-sectional view of the swellable packer, the swellable packer being swollen.

In FIG. 3, a cross-sectional view of the packer 12 is representatively illustrated, in which the swellable material 28 is unswollen, and the depicted conductor 32 forms a continuous conductive path around the tubular 34 and a portion of the swellable material. In FIG. 4, the swellable material 28 has swollen, and as a result, the conductor 32 has parted, so that the conductive path about the tubular 34 is no longer continuous.

It will be appreciated by those skilled in the art that the conductor 32 as depicted in FIG. 3 has different electromagnetic characteristics as compared to the conductor as depicted in FIG. 4. For example, a magnetic field may propagate more readily and uniformly in the seal element 26 with the conductor 32 being continuous as in FIG. 3, rather than with the conductor being discontinuous as in FIG. 4. An electrical current can flow completely around in the seal element 26 in FIG. 3, but only partially around in FIG. 4.

Although in FIGS. 2-4 each conductor 32 is depicted as being made of a single piece of material, in other examples a conductor could be made of multiple elements.

A well tool 36 can be conveyed into the tubular string 14 (e.g., by wireline, slickline, coiled tubing, etc.) and positioned near the conductors 32, in order to detect the electromagnetic characteristics of the conductors. These electromagnetic characteristics can be evaluated to determine whether the conductors 32 have parted and, thus, whether the seal element 26 has swollen sufficiently to seal against the wall 24.

The sensor 38 may be any type of sensor which is capable of detecting electromagnetic characteristics of the conductors 32 from within the tubular 34. One example is a nuclear magnetic resonance sensor, but other types of sensors may be used in keeping with the scope of this disclosure.

Figure 5:
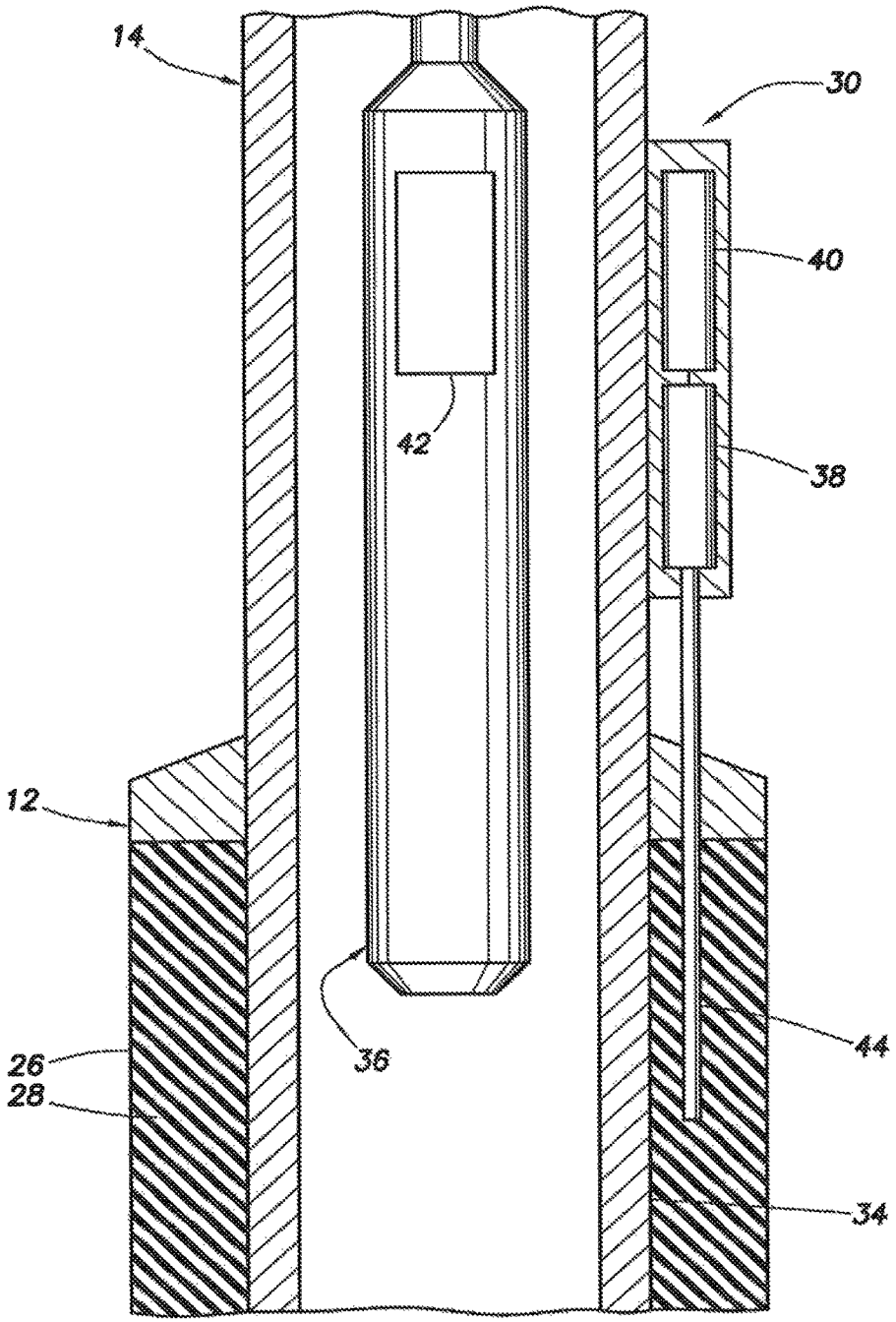
FIG. 5 is a representative partially cross-sectional view of a packer swelling verification system which can embody principles of this disclosure.

Referring additionally now to FIG. 5, another configuration of the swelling verification system 30 is representatively illustrated. In this configuration, the sensor 38 is used to sense a pressure in the seal element 26.

Instead of being included in the well tool 36 as in the FIGS. 2-4 configuration, in the example of FIG. 5 the sensor 38 is installed in the well along with the packer 12. The sensor 38 does, however, transmit to the well tool 36 parameters indicative of a degree, amount or level of swelling of the swellable material 28.

The transmitting of these parameters is accomplished by means of a transmitter 40 of the swelling verification system 30, and a receiver 42 of the well tool 36 conveyed through the tubular string 14. Either or both of the transmitter 40 and receiver 42 could be a transceiver (both a transmitter and a receiver) in some examples.

The transmission of the parameters from the transmitter 40 to the receiver 42 could be by any appropriate transmission technique. For example, radio frequency transmission, other electromagnetic transmission, inductive coupling, acoustic transmission, wired transmission (e.g., via a wet connect, etc.), or any other type of transmission technique may be used in keeping with the scope of this disclosure.

The sensor 38 in this configuration can comprise any type of pressure sensor (e.g., fiber optic, piezoelectric, strain gauge, crystal, electronic, etc.), and can be arranged to detect pressure in the seal element 26 in any of a variety of ways. In the FIG. 5 example, a probe 44 extends from the sensor 38 into the swellable material 28 of the seal element 26.

As the swellable material 28 swells and eventually contacts the wall 24, pressure in the seal element 26 will increase. The pressure increase (or lack thereof) will be detected by the sensor 38 via the probe 44, and indications of the measured pressure parameter will be transmitted via the transmitter 40 and receiver 42 to the well tool 36.

The pressure indications may be stored in the well tool 36 for later retrieval, and/or the pressure indications may be transmitted to a remote location for storage, analysis, etc. Note that the parameters transmitted to the well tool 36 are not necessarily limited to pressure in the seal element 26, since a variety of different parameters can be indicative of whether or to what degree the swellable material 28 has swollen. Any parameter, any number of parameters, and any combination of parameters may be transmitted to the well tool 36 in keeping with the scope of this disclosure.

Figure 6:
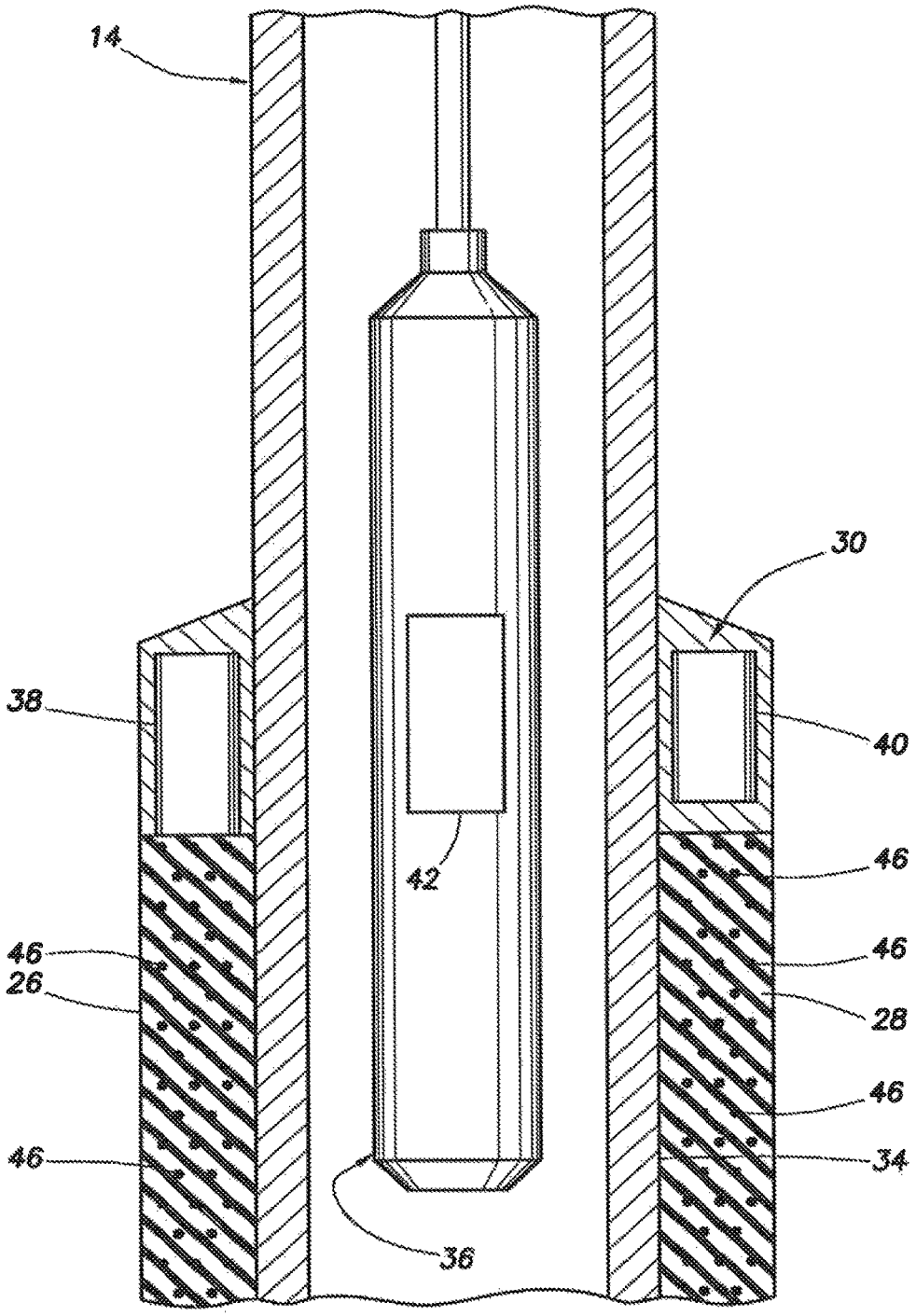
FIG. 6 is a representative cross-sectional view of another configuration of the packer swelling verification system.

Referring additionally now to FIG. 6, another configuration of the swelling verification system 30 is representatively illustrated. In this configuration, the sensor 38 senses a density and/or a radioactivity in the seal element 26, which parameters are indicative of swelling of the swellable material 28.

In one example, the sensor 38 can sense a density of the swellable material 28 directly. The sensor 38 could comprise a density sensor (e.g., a nuclear magnetic resonance sensor, gamma ray sensor, etc.).

In another example, the sensor 38 can sense a density of particular elements distributed in the swellable material 28. The elements 46 could be particles, spheres, grains, nanoparticles, rods, wires, or any other type of elements whose density in the swellable material 28 is affected by swelling of the swellable material.

For example, if the elements 46 are metal spheres, a mass of the metal spheres per unit volume of the swellable material 28 will decrease as the swellable material swells (e.g., as a volume of the swellable material increases). In this example, the reduction in density of the elements 46 in the swellable material 28 could be detected by monitoring a corresponding change in the electromagnetic properties of the seal element 26 as it swells.

In another example, the elements 46 could have a (preferably, relatively low) level of radioactivity. As the swellable material 28 swells, the radioactive elements 46 are more widely dispersed, and so a relative level of radioactivity sensed by the sensor 38 is reduced. The sensor 38 in this example could comprise any type of radioactivity sensor (e.g., a scintillation counter, etc.).

In another example, the swellable material 28 may comprise, in whole or in part, an electrically conductive and flexible elastomer material. This material may be formed from a molecular-level self-assembly production process, such that layers of positively charged particles may alternate with layers of negatively charged particles, held together by electrostatic charges. Such a material is manufactured and sold by NanoSonic, Inc., of Pembroke, Va., USA under the trade name Metal Rubber™, and a similar material is described in U.S. Pat. No. 7,665,355, the entirety of which is hereby incorporated by reference.

In Metal Rubber™ and similar conductive elastomer materials, positively charged layers are conductive layers and are formed of inorganic materials such as metals or metal oxides. The negatively charged layers are formed of organic molecules, such as polymers or elastomers. In this example, as the swellable material swells, the Metal Rubber™ (or similar conductive elastomer) material is deformed by its own swelling and/or by the swelling of the surrounding matrix, and the electrical resistance of the conductive elastomer material changes due to the deformation.

The sensor 38 in this example may comprise a circuit attached to the conductive elastomer material, using methods known to those skilled in the art (for example, by applying a known electrical potential across the material and measuring the resulting current, or flowing a known current through the material and measuring the electrical potential, etc.). Thus, the degree of swelling can be readily determined by measuring the resistance of the swellable material 28. Such swelling may also cause alterations of other electrical properties or magnetic properties of the conductive elastomer material, which can likewise be determined using various sensors known to those skilled in the art.

It may now be fully appreciated that significant benefits are provided by this disclosure to the art of swelling verification in wells. The swelling verification system 30 described above can detect whether or to what degree the swellable material 28 has swollen, and this information can be conveniently recovered by means of the well tool 36 conveyed through the tubular string 14.

The above disclosure describes a method of verifying whether a swellable material 28 has swollen in a well. The method can include connecting a transmitter 40 to a sensor 38 which senses a parameter indicative of whether the swellable material 28 has swollen, and conveying a receiver 42 into an interior of a tubular string 14. The transmitter 40 transmits to the receiver 42 an indication of degree of swelling of the swellable material 28.

The sensor 38 may sense at least one of a pressure, a density, a resistance and radioactivity in the swellable material 28.

The swellable material 28 may comprise multiple oppositely charged layers of at least a first and a second material held together by electrostatic charges.

The sensor 38 may sense changes in the resistance of at least a portion of the swellable material 28.

The sensor 38 may sense continuity of a conductor 32 in the swellable material 28. The conductor 32 may part in response to swelling of the swellable material 28.

Conveying the receiver 42 into the tubular string 14 can be performed after swelling of the swellable material 28 is initiated.

Also described above is a packer swelling verification system 30. The system 30 can include a swellable material 28 which swells in a well, and a well tool 36 which is conveyed to the packer 12 in the well. The well tool 36 verifies whether the swellable material 28 has swollen.

The system 30 can include a sensor 38 which senses a parameter indicative of whether the swellable material 28 has swollen. The sensor 38 may be conveyed with the well tool 36.

The sensor 38 may detect whether a conductor 32 of the packer 12 has parted. The sensor 38 may sense at least one of pressure, density, resistivity and radioactivity in the swellable material 28.

The system 30 can include a transmitter 40 which transmits to the well tool 36 an indication of whether the swellable material 28 has swollen. The well tool 36 may include a receiver 42 which receives the indication of whether the swellable material 28 has swollen.

The above disclosure also describes a method of verifying whether a swellable material 28 has swollen in a well, with the method including positioning a conductor 32 proximate the swellable material 28. The conductor 32 parts in response to swelling of the swellable material 28. The method includes detecting whether the conductor 32 has parted.

The detecting step can include conveying a sensor 38 into the well proximate the conductor 32, whereby the sensor 38 detects whether the conductor 32 has parted. The conveying step can include conveying the sensor 38 through a tubular string 14 in the well.

The step of positioning the conductor 32 may include embedding the conductor 32 in the swellable material 28.

The positioning step may include encircling a tubular string 14 with the conductor 32.

The method can include allowing the swellable material 28 to swell in an annulus 22 formed between a tubular string 14 and an encircling wall 24 in the well.

It is to be understood that the various examples described above may be utilized in various orientations, such as inclined, inverted, horizontal, vertical, etc., and in various configurations, without departing from the principles of this disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of this disclosure. Accordingly, the foregoing detailed description is to be clearly understood as being given by way of illustration and example only, the spirit and scope of the invention being limited solely by the appended claims and their equivalents.

What is claimed is:

1. A method of verifying swelling of a swellable material in a well, the method comprising:

connecting a transmitter to a sensor which senses a parameter indicative of degree of swelling of the swellable material; and conveying a receiver into an interior of a tubular string, whereby the transmitter transmits to the receiver an indication of the degree of swelling of the swellable material, wherein the swellable material comprises multiple oppositely charged layers of at least a first and a second material held together by electrostatic charges.

2. The method of claim 1, wherein the sensor senses changes in the electrical resistance of at least a portion of the swellable material.

* * * * *